US009228357B1

(12) United States Patent
Varela et al.

(10) Patent No.: US 9,228,357 B1
(45) Date of Patent: Jan. 5, 2016

(54) ROOFING DEVICE

(71) Applicants: Henry Varela, Yuma, AZ (US); Rosa Lopez, Yuma, AZ (US)

(72) Inventors: Henry Varela, Yuma, AZ (US); Rosa Lopez, Yuma, AZ (US)

( * ) Notice: Subject to any disclaimer, the term of this patent is extended or adjusted under 35 U.S.C. 154(b) by 0 days.

(21) Appl. No.: 14/715,673

(22) Filed: May 19, 2015

Related U.S. Application Data

(60) Provisional application No. 62/000,285, filed on May 19, 2014.

(51) Int. Cl.
*E04D 13/17* (2006.01)
*E04B 1/92* (2006.01)
*E04H 9/14* (2006.01)

(52) U.S. Cl.
CPC ..... *E04D 13/174* (2013.01); *E04B 1/92* (2013.01); *E04D 13/178* (2013.01); *E04H 9/14* (2013.01); *E04D 13/17* (2013.01)

(58) Field of Classification Search
CPC ..... E04D 13/17; E04D 13/174; E04D 13/178; E04H 9/14; E04B 1/92
See application file for complete search history.

(56) References Cited

U.S. PATENT DOCUMENTS 3,863,553 A * 2/1975 Koontz ..... F24F 7/00 454/260
4,184,416 A * 1/1980 Koontz ..... E04D 13/178 454/260
4,189,878 A * 2/1980 Fitzgerald ..... F24F 7/04 454/260
4,201,121 A * 5/1980 Brandenburg, Jr. ..... E04D 13/17 454/250
4,214,510 A * 7/1980 Ward ..... E04D 13/178 454/260
4,265,060 A * 5/1981 Woodhams ..... E04D 13/178 454/260
4,297,818 A * 11/1981 Anderson ..... F24F 7/02 454/366
4,565,037 A * 1/1986 DeSchane ..... E04D 13/178 454/260
4,607,566 A * 8/1986 Bottomore ..... E04D 13/152 454/260
4,611,443 A * 9/1986 Jorgensen ..... E04D 13/178 454/260
4,776,262 A * 10/1988 Curran ..... E04D 13/178 454/260
5,007,216 A * 4/1991 Pearson ..... E04B 1/74 454/260
5,238,450 A * 8/1993 Rotter ..... E04D 13/152 454/260
5,605,022 A * 2/1997 Fulton ..... E04D 13/174 454/365
5,996,289 A * 12/1999 Allaster ..... E04D 13/152 52/95
6,145,255 A * 11/2000 Allaster ..... E04D 13/152 52/302.1
6,147,295 A * 11/2000 Mimura ..... E04D 13/17 135/246
6,220,956 B1 * 4/2001 Kilian ..... F24F 11/0001 454/239
7,540,118 B2 * 6/2009 Jensen ..... A62C 2/065 169/70
8,137,170 B2 * 3/2012 Klement ..... E04D 13/178 126/621
8,562,400 B2 * 10/2013 Klement ..... E04D 13/178 126/621
8,782,967 B2 * 7/2014 Daniels ..... E04D 1/30 454/250
2008/0028704 A1 * 2/2008 Cooper ..... E04D 13/17 52/302.1

* cited by examiner

*Primary Examiner* — Andrew J Triggs
(74) *Attorney, Agent, or Firm* — Sandy Lipkin

(57) ABSTRACT

A method and apparatus for a roof that takes the pressure from wind in extreme weather events off of the eaves and roof of a building thereby allowing the roof to stay intact and increasing the likelihood that the building will not collapse under the influence of the weather event. The apparatus of the instant invention allows the airflow from the wind to continue on its natural path.

3 Claims, 2 Drawing Sheets

ROOFING DEVICE

REFERENCE TO PRIOR APPLICATION

This application claims priority of the provisional patent application 62/000,285, filed May 19, 2014 entitled ROOFING DEVICE by Henry Abel Varela and Rosa Lopez.

BACKGROUND OF THE INVENTION

1. Field of the Invention

The present invention relates to the field of roofing systems, and more particularly toward a roofing system that is resistant to high winds.

2. Description of the Prior Art

During weather events, such as high winds, hurricanes and tornadoes, the roofs on structures are at risk of being blown off and causing the dwelling to collapse. Typically during such weather events, the windows and doors are boarded up to keep them secure, but it actually causes the wind to run up the side of the walls, hitting the eaves and putting pressure on the roof. The constant pulsating of the wind eventually rips off the roof or portions of the roof which in turn can cause the walls to collapse.

It is the object of the instant invention to provide a roofing system and apparatus that will take the pressure from the wind in such events off of the eaves and roof thereby allowing the roof to stay intact. This increases the chances of the building remaining intact during the weather event.

SUMMARY OF THE INVENTION

The basic embodiment of the present invention teaches a wind venting system for a roof comprising: a building with three or more walls; a roof situated atop said three or more walls, said roof having eaves that hang over said three or more walls; and one or more eave panels situated on said eaves wherein said one or more eave panels is releasably attached to said eave through a hinging mechanism wherein said one or more eave panels are pushed upward from said eaves along said hinging mechanism to allow for the exit therefrom from high winds that blow up against said three or more walls.

The above embodiment can be further modified by defining that said roof is pitched and said building further comprises: one or more roof panels that are releasably attached to said roof separate from said eave panels; an attic; and one or more attic panels through which high winds can move through said attic and out through said one or more roof panels.

The above embodiment can be further modified by defining that said roof is flat.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
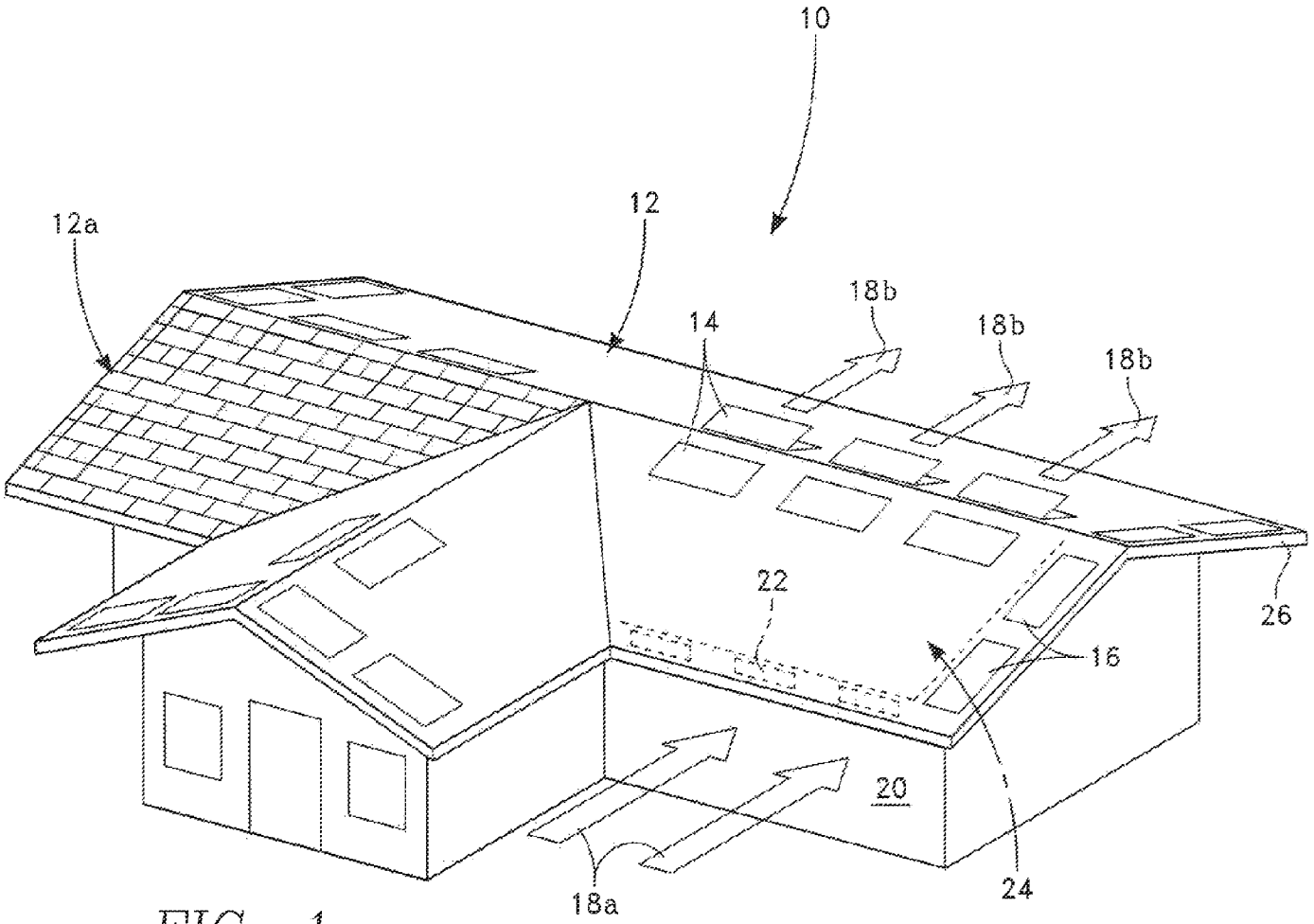
FIG. 1 is a top front perspective view of a building with a pitched roof utilizing the system and apparatus of the instant invention.

Turning to the drawings, the preferred embodiment is illustrated and described by reference characters that denote similar elements throughout the several views of the instant invention.

In the preferred embodiment, the instant invention provides a method and apparatus, i.e., a system 10 that will take the pressure from wind 18*a* in extreme weather events off of the eaves 26 and roof 12 of a building 20 thereby allowing the roof 12 to stay intact and increasing the likelihood that the building 20 will not collapse under the influence of the weather event.

The apparatus 10 of the instant invention allows the airflow 18*b* from the wind 18*a* to continue on its natural path. The wind 18*a* flows under the eaves 26 into a funnel or vent 14 approximately 1.5 feet long and 1.5 feet wide. The dimensions can be modified depending on the roof 12.

During the high winds, the air 18*a* that hits the building 20 that would normally direct itself against the obstacles of the building can now travel through a tube in the attic 24. The moving air 18*a* would exhaust on the highest point of the opposite side which removes the air lift pressure from the eaves 26 and directing it to travel its natural course through the vents 14. Some of the vents 16 are placed on the overhang of the eaves 26 on the outside of the building. Further, the attic 24 can have attic vents 22 that provide the same pressure relief. The outside appearance of the structure 20 is not changed by the inclusion of these vents.

As illustrated in FIG. 1, a tiled area of the roof 12*a* can provide camouflage for the vents 14. This is because the exhaust vents 14 on top of the roof 12 look just like the roof tiles 12*a* or whatever the roof's appearance happens to be when closed. The only time the vents 14, 16, 22 are visible is when they are open, i.e., when the wind 18*a*, 18*b* is at its highest. When the wind 18*a*, 18*b* stops blowing, the vents 14, 116, 22 close and return to not being visible. However, it does allow the roof 12 to be relieved of high wind pressure in an extreme weather event.

Figure 2:
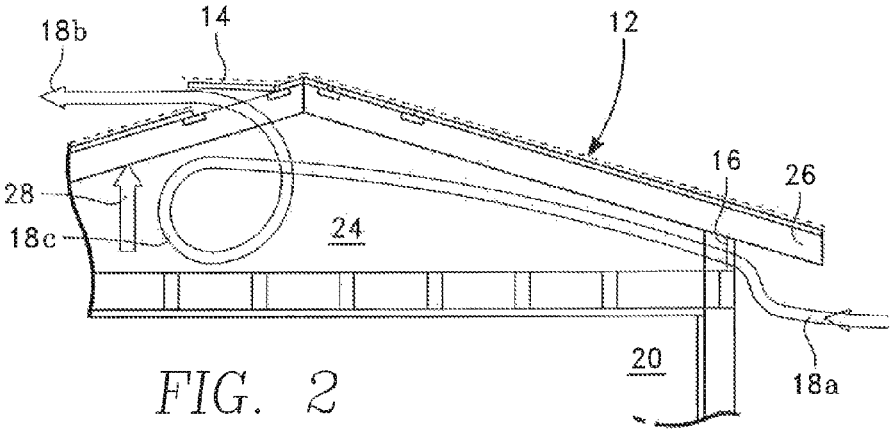
FIG. 2 is a side view of a pitched roof demonstrating the pressure build-up from high winds.
Figure 3:
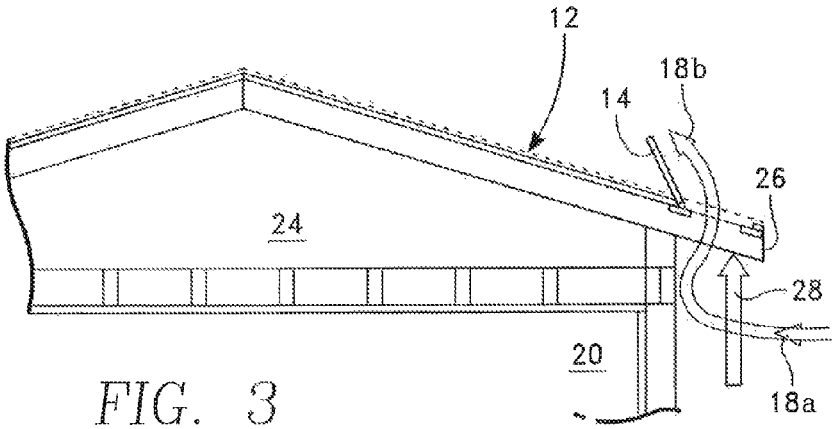
FIG. 3 is a side view of a pitched roof demonstrating how the force of the wind is diverted with the device of the instant invention.

FIGS. 2 and 3 show a side view of how the wind 18*c* builds up pressure in the attic 24 before exiting the building 20 through the vent 14 on the roof 12. The force that would normally be sufficient to blow off the roof 12 is designated as number 28. The high winds 18*a* blow toward the building 20 and hit the obstacle. It is redirected into the attic 24 through the attic vent 16 somewhat but ultimately the roof removal force 28 moves the air pressure upward and out of the vent 14 in the roof 12.

FIG. 3 shows the system 10 without an attic 24. The wind 18*a* moves toward the building 20 and hits the obstacle. The roof removal force 28 is found at this point of the building 20 rather than in the attic 24. The vent 14 is found on the eave 26 and roof removal force 28 exits out the vent 14.

Figure 4:
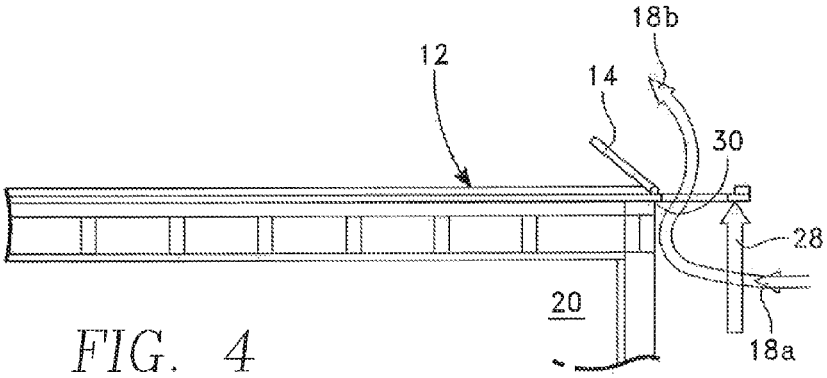
FIG. 4 is a side view of a flat roof demonstrating how the force of the wind is diverted with the device of the instant invention.

FIG. 4 illustrates the system 10 on a flat roof 12. In the flat roof embodiment, the exhaust ports, i.e., vents 14 are placed all along the edge 30 of the building 20 to immediately exhaust the roof removal force 28 from the upward lift of high winds through the vent 14 thereby allowing the air 18*b* to exhaust and relieve the pressure from the roof 12.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A wind venting system for a roof comprising:

a building with three or more walls;

a roof situated atop said three or more walls, said roof having eaves that hang over said three or more walls; and one or more eave panels situated on said eaves wherein said one or more eave panels is releasably attached to said eave through a hinging mechanism wherein said one or more eave panels are pushed upward from said eaves along said hinging mechanism to allow for the exit therefrom from high winds that blow up against said three or more walls.

2. The wind venting system as defined in claim 1 wherein said roof is pitched and said building further comprises:

one or more roof panels that are releasably attached to said roof separate from said eave panels;

an attic; and one or more attic panels through which high winds can move through said attic and out through said one or more roof panels.

3. The wind venting system as defined in claim 1 wherein said roof is flat.

* * * * *